US006756865B2

(12) United States Patent
Saito et al.

(10) Patent No.: US 6,756,865 B2
(45) Date of Patent: Jun. 29, 2004

(54) RESONATOR DEVICE, FILTER, DUPLEXER, AND COMMUNICATION APPARATUS USING THE SAME

(75) Inventors: Kenji Saito, Ishikawa-gun (JP); Hiroki Wakamatsu, Kyoto (JP); Tomoyuki Ise, Yokohama (JP)

(73) Assignee: Murata Manufacturing Co. Ltd

( * ) Notice: Subject to any disclaimer, the term of this patent is extended or adjusted under 35 U.S.C. 154(b) by 0 days.

(21) Appl. No.: 10/116,644

(22) Filed: Apr. 3, 2002

(65) Prior Publication Data

US 2003/0137368 A1 Jul. 24, 2003

(30) Foreign Application Priority Data

Apr. 4, 2001 (JP) ..... 2001-106520
Jul. 6, 2001 (JP) ..... 2001-206159

(51) Int. Cl.[7] ..... H01P 1/213; H01P 7/10

(52) U.S. Cl. ..... 333/134; 333/219.1; 333/202; 333/212; 333/227

(58) Field of Search ..... 333/134, 202, 333/212, 219.1, 219, 227

(56) References Cited

U.S. PATENT DOCUMENTS 4,271,399 A 6/1981 Morita
5,710,530 A * 1/1998 Wada et al. ..... 333/219.1
5,754,083 A * 5/1998 Abe et al. ..... 333/219.1
5,764,115 A * 6/1998 Hattori et al. ..... 333/202
5,783,979 A * 7/1998 Andoh et al. ..... 333/202
6,002,311 A * 12/1999 Wey et al. ..... 333/219.1
6,549,092 B1 * 4/2003 Hattori et al. ..... 333/134

FOREIGN PATENT DOCUMENTS

EP 1091441 A2 * 4/2001 ..... H01P/1/205
JP 08-0065005 3/1996

* cited by examiner

*Primary Examiner*—Benny T. Lee
*Assistant Examiner*—Kimberly Glenn
(74) *Attorney, Agent, or Firm*—Dickstein, Shapiro, Morin & Oshinsky, LLP.

(57) ABSTRACT

A multi-mode resonator device can be reduced in size even while increasing the number of resonators while including either a semi-coaxial resonator or a coaxial resonator. Coupling between a TEM mode as a resonance mode of the semi-coaxial resonator and a TM mode as another resonance mode can be facilitated, which enables coupling between the resonators at a predetermined coupling strength. Inside a cavity with a cover, a conductive rod and a dielectric core are disposed so as to substantially equalize a quasi-TEM-mode resonant frequency generated by the cavity and the conductive rod and a quasi-TM-mode resonant frequency generated by the cavity and the dielectric core. A coupling adjusting block is arranged at a place where the magnetic field of one of two coupling modes generated by the quasi-TEM and quasi-TM modes is strong and that of the other mode is weak. The invention also provides a filter, duplexer, and a communication apparatus using the resonator device.

11 Claims, 17 Drawing Sheets

FIRST COUPLING MODE

SECOND COUPLING MODE

RESONATOR DEVICE, FILTER, DUPLEXER, AND COMMUNICATION APPARATUS USING THE SAME

BACKGROUND OF THE INVENTION

1. Field of the Invention

The present invention relates to a resonator device including a plurality of resonators, a filter, a duplexer, and a communication apparatus using the resonator device.

2. Description of the Related Art

Publicly known resonators capable of handling a relatively large amount of power in a microwave band include cavity resonators and semi-coaxial resonators. A semi-coaxial resonator is also referred to as a coaxial cavity resonator. It has a relatively high Q factor, and is smaller than a cavity resonator. Accordingly, the use of semi-coaxial resonators contributes to the miniaturization of filters and the like.

However, for example, in a cellular mobile communication system such as a mobile phone system, with the spread of micro-cellular networks, there has been a growing demand for more compact filters for use in base stations.

On the other hand, when the number of stages of resonators is increased in a filter using a semi-coaxial resonator, a number of additional resonators equivalent to the number of increased stages are needed, with the result that the entire filter becomes larger.

SUMMARY OF THE INVENTION

Accordingly, the present invention provides a multi-mode resonator device, which can be miniaturized even while increasing the number of resonators, using either a semi-coaxial resonator or a coaxial resonator. Coupling between a TEM mode of the semi-coaxial resonator and another resonance mode such as a TM mode can be facilitated, so that coupling can be provided between the resonators with a predetermined coupling strength.

The present invention also provides a filter, a duplexer, and a communication apparatus using the resonator device.

According to a first aspect of the present invention, there is provided a resonator device including a conductive cavity, a conductive rod disposed in the cavity, at least one end of the conductive rod being conductively connected to the inside of the cavity, a dielectric core disposed in the cavity, the resonant frequency of a quasi-TEM mode generated by the conductive rod and the cavity being substantially equalized with the resonant frequency of a quasi-TM mode generated by the dielectric core and the cavity, and a conductive member disposed such that it is disposed at or removed from a place where the magnetic field of one of two coupling modes generated by the quasi-TEM mode and the quasi-TM mode is strong and the magnetic field of the other coupling mode is weak.

In addition, according to a second aspect of the present invention, a resonator device includes a dielectric member and a conductive member disposed such that they are disposed at or removed from a place where the electric field of one of two coupling modes generated by the quasi-TEM mode and the quasi-TM mode is strong and the electric field of the other coupling mode is weak.

These structures make a difference between the resonant frequencies of the two coupling modes obtained from the quasi-TEM mode and the quasi-TM mode to enable the coupling between the quasi-TEM mode and the quasi-TM mode.

Furthermore, according to a third aspect of the present invention, a resonator device includes a conductive cavity, a conductive rod disposed in the cavity, at least one end of the conductive rod being conductively connected to the inside of the cavity, a dielectric core disposed in the cavity, the resonant frequency of a quasi-TEM mode generated by the cavity and the conductive rod being substantially equalized with the resonant frequency of a quasi-TM mode generated by the cavity and the dielectric core, and a dielectric member and a conductive member disposed such that they are disposed at or removed from a place where the electric-field vectors of the quasi-TEM mode and the quasi-TM mode significantly overlap each other.

In addition, according to a fourth aspect of the present invention, a resonator device includes a conductive member and a magnetic member disposed such that they are disposed at or removed from a place where the magnetic-field vectors of the quasi-TEM mode and the quasi-TM mode significantly overlap each other.

With the structure, the quasi-TEM mode and the quasi-TM mode are coupled with each other.

Furthermore, in this invention, the resonator device may further include a hole formed substantially at the center of the dielectric core with the conductive rod passing through the hole, and the conductive rod may be arranged in such a manner that the center of the conductive rod is shifted from the center of the hole, instead of disposing or removing the conductive member.

Furthermore, the resonator device of the invention may further include a hole formed in the dielectric core with the conductive rod passing through the hole in such a manner that the center of the hole is shifted from the center of the conductive rod, instead of disposing or removing the dielectric member.

As a result, by arranging the conductive rod or the hole through which the conductive rod penetrates, the quasi-TEM mode and the quasi-TM mode are coupled with each other.

Furthermore, in the resonator device of the present invention, the quasi-TM mode may include dual quasi-TM modes having electric fields directed perpendicularly to the dielectric core. With this structure, the resonator device resultantly includes a triplex-mode resonator using the dual quasi-TM modes and the quasi-TEM mode.

In the resonator device of the present invention, the conductive member may be disposed on an inner surface of the cavity at a position overlapping with the dielectric core when viewed from the axial direction of the conductive rod. As a consequence, bonding and arrangement of a coupling conductor member can be simplified and therefore the device can be easily manufactured.

In addition, in the resonator device of the present invention, the conductive member may be integrally molded with the cavity. As a consequence, the resonator device can be manufactured easily.

In addition, in the resonator device of the invention, the conductive member may be a metal screw arranged on the conductive cavity in such a way that the amount of insertion into the cavity can be changed from the outside. In this arrangement, the conductive member can be used for coupling adjustment by a simple turning operation.

According to a fifth aspect of the present invention, a filter includes the resonator device of the invention, and input and output conductors for inputting and outputting signals by coupling with predetermined resonance modes of the resonance modes.

According to a sixth aspect of the present invention, a duplexer includes a pair of filters formed by the above filter. In this duplexer, an input port of a first filter is a transmission signal input port, an output port of a second filter is a reception signal output port, and an input and output port common to the first and second filters is an antenna port.

According to a seventh aspect of the present invention, a communication apparatus includes one of the filter and the duplexer described above.

Other features and advantages of the present invention will become apparent from the following description of embodiments of the invention which refers to the accompanying drawings.

DESCRIPTION OF EMBODIMENTS OF THE INVENTION

With reference to FIGS. 1 to 5, a description will be given of the structure of a resonator device according to a first embodiment of the present invention.

Figure 1:
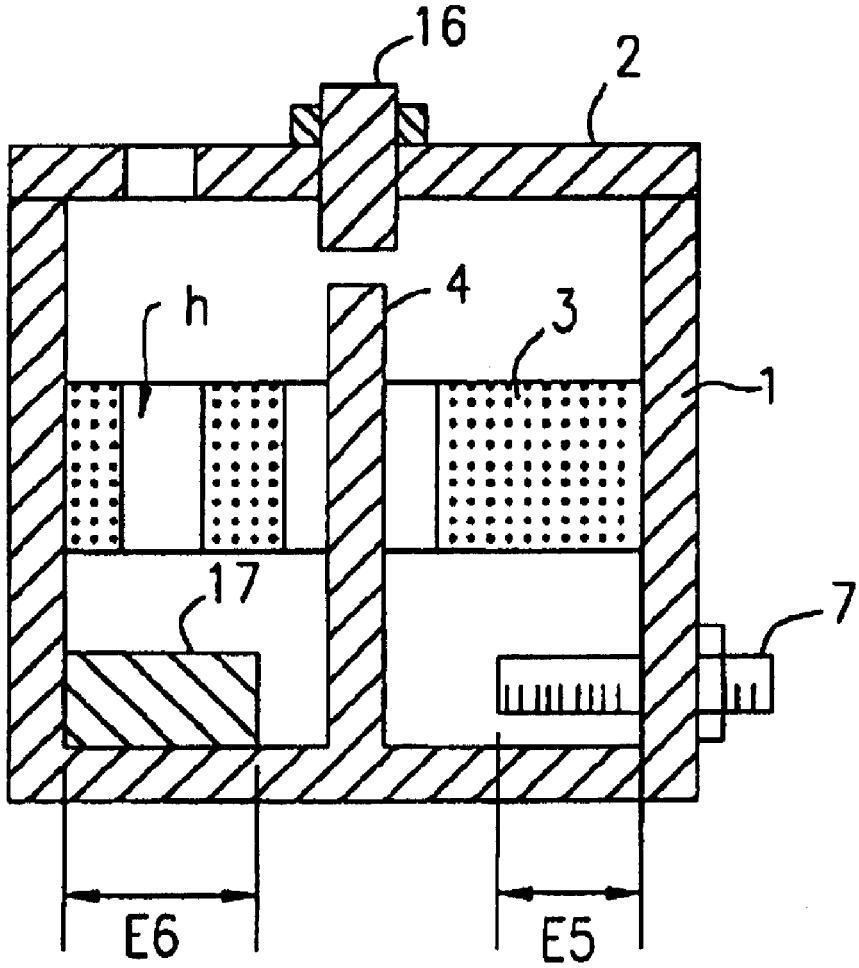
FIG. 1 shows a section of a dual-mode resonator device according to a first embodiment of the present invention.

FIG. 1 is a section showing the structure of a dual-mode resonator. In FIG. 1, reference numeral 2 denotes a cover for covering the opening part of a cavity 1. At the center of the cavity's cover 2, a frequency adjusting screw 16 is disposed to adjust a resonant frequency by setting a predetermined distance between the top end of a conductive rod 4 and the inner surface of the cover.

Both end faces of the lengthwise direction of a dielectric core 3 are bonded with the inner wall surfaces of the cavity 1. In this example, an Ag electrode is formed on each of the end faces of the dielectric core 3 and the end faces are connected to the inner wall surfaces of the cavity 1 by soldering in such a manner that the dielectric core 3 is positioned at the center of the space inside the cavity. The cavity 1 and the cover 2 are formed by cutting a metal material to define a cavity, or alternatively, by forming a conductive film on a ceramic or resin material.

At a predetermined position on the inner bottom surface of the cavity 1, a coupling adjusting block 17 is disposed. The coupling adjusting block 17 may be molded integrally with the cavity 1 for example, or a rectangular-parallelepiped metal block may be fixed in the cavity with a screw. The coupling adjusting block 17 enables adjustment of the amount of coupling between a TEM mode and a TM mode, which will be described below. In addition, a coupling adjusting hole h is formed in the dielectric core 3. From the outside of the cavity, a dielectric rod is inserted into the coupling adjusting hole h. By the amount of insertion, the amount of coupling between the TEM mode and the TM mode is adjusted.

Figure 2A:
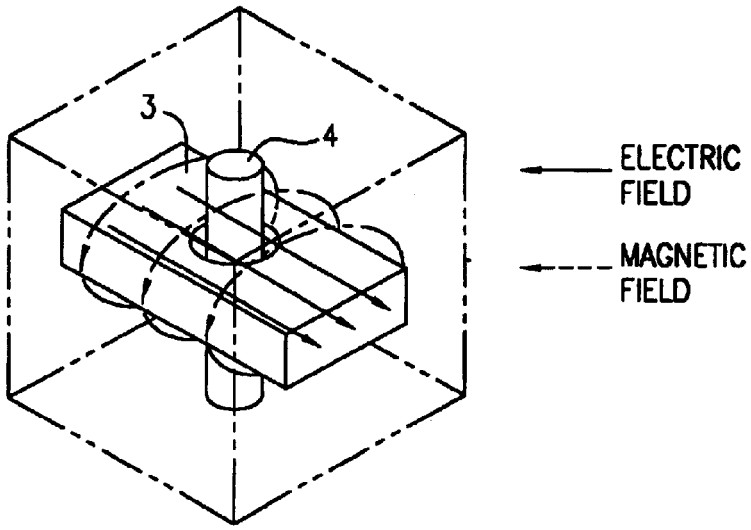
FIGS. 2A to 2C show the electromagnetic-field distributions of resonance modes of a dual-mode resonator included in the resonator device.
Figure 2B:
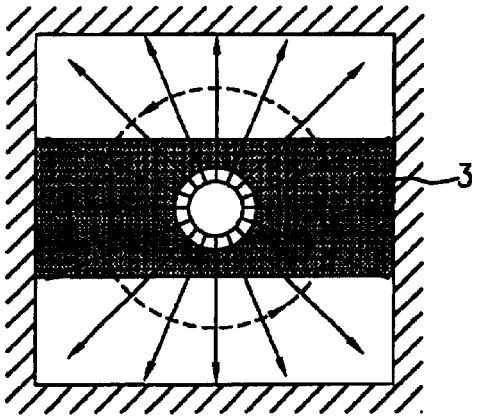
Figure 2C:
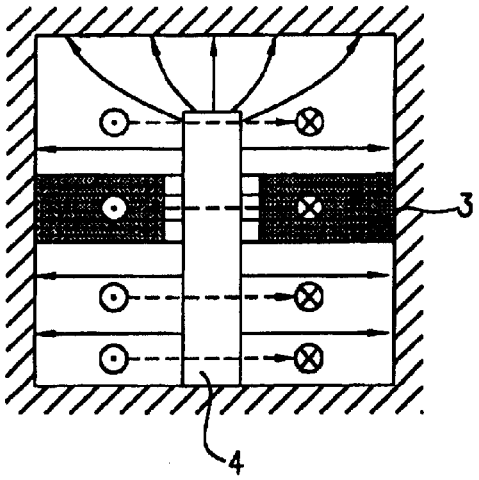

FIGS. 2A to 2C show examples of electromagnetic-field distributions of modes in the dual-mode resonator. In these figures, solid arrows indicate electric-field vectors and broken arrows indicate magnetic-field vectors.

FIG. 2A shows the electromagnetic-field distribution of a TM mode generated by the dielectric core 3 and the cavity. In this mode, the electric-field vectors are directed in the lengthwise direction of the dielectric core 3 and the magnetic-field vectors form loops in planes perpendicular to the lengthwise direction of the dielectric core 3. In this case, although the dielectric core has a rectangular-parallelepiped shape, a cylindrical coordinate system is used to express the modes. The symbol h indicates a propagating direction, the symbol θ indicates a looping direction within a plane perpendicular to the propagating direction, and the symbol r indicates a radial (radius) direction within a plane perpendicular to the propagating direction. The number of waves in the electric-field intensity distribution is expressed in the order of TM, θ, r, and h. Thus, the present mode can be expressed as a TM010 mode. However, unlike a normal TM010 mode, in this case, the dielectric core is not cylindrical and the conductive rod 4 is arranged at the center of the dielectric core 3. So, the mode is a quasi-TM mode corresponding to the TM010 mode. Hereinafter, this mode will be referred to simply as a "TM mode".

FIG. 2B shows a top view of a semi-coaxial resonator formed by the cavity and the conductive rod and FIG. 2C shows a front view thereof. In the TEM mode, the electric-field vectors are oriented in directions radiating toward the inner-wall surfaces of the cavity from the conductive rod and the magnetic-field vectors form loops around the conductive rod at the center. However, unlike a normal semi-coaxial resonator, due to the configuration of the dielectric core and also to the gap between the top of the conductive rod 4 and the ceiling surface of the cavity 1, the mode is a quasi-TEM mode corresponding to a TEM mode. Hereinafter, this mode will be referred to simply as a "TEM mode".

FIGS. 3A to 3D show the examples of magnetic-field distributions of the two coupling modes obtained with the TM mode and the TEM mode shown in FIG. 1 and FIGS. 2A to 2C.

Figure 3A:
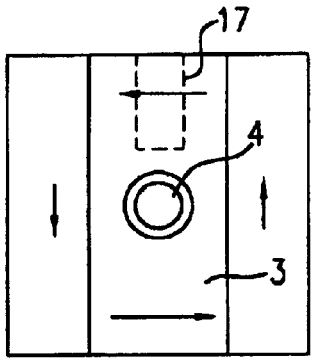
FIGS. 3A to 3D show the magnetic-field distributions of two coupling modes of the dual-mode resonator.
Figure 3C:
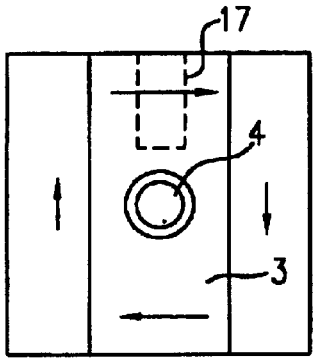
Figure 3B:
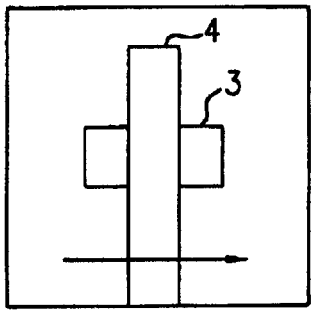
Figure 3D:
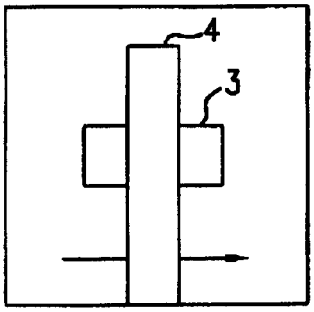

Here, a first coupling mode shown in FIGS. 3A and 3B is equivalent to a mode obtained by synthesizing the TEM mode and the TM mode. In this situation, when viewed from the top of the conductive rod 4 in the axial direction, the TEM-mode magnetic field rotates in the counterclockwise direction and the TM-mode magnetic field is oriented in the direction toward the right below the dielectric core 3 (FIG. 3B). A second coupling mode shown in FIGS. 3C and 3D is equivalent to a mode generated by synthesizing the TEM mode and the TM mode. In the second coupling mode, the TEM-mode magnetic field rotates in the clockwise direction and the TM-mode magnetic field is oriented in the direction toward the right below the dielectric core 3 (FIG. 3D).

As shown in FIGS. 3A and 3C, for the two coupling modes obtained with the TEM resonance mode and the TM resonance mode, a coupling adjusting block 17 is disposed at a place where the magnetic field in one of the coupling modes (the first coupling mode) is weak and the magnetic field in the other coupling mode (the second coupling mode) is strong. With this structure, although there is little increase in the resonant frequency of the first coupling mode, the resonance frequency of the second coupling mode is increased to couple the TEM mode and the TM mode more strongly. The strength of coupling between the modes is determined by the magnitude of deviation between the two coupling-mode resonant frequencies, that is, by the size of the coupling adjusting block 17.

Figure 4:
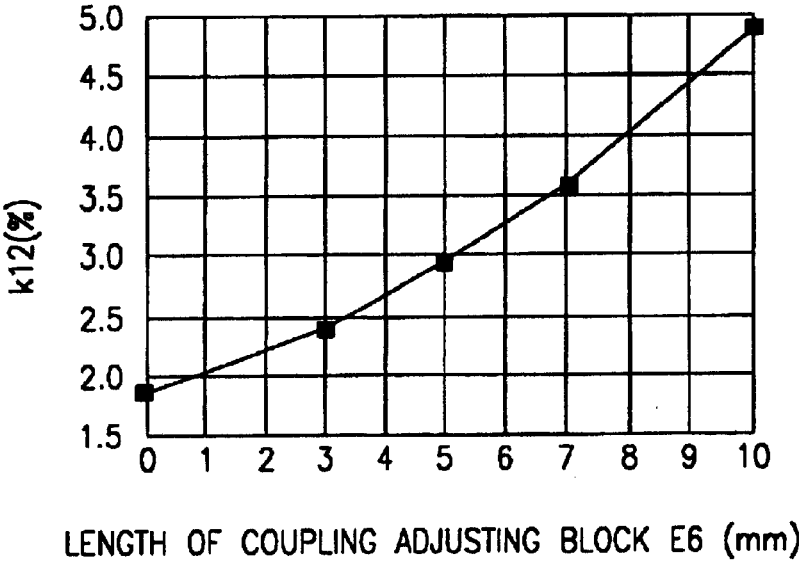
FIG. 4 is a graph of the relationship between the length of a coupling adjusting block and the coefficient of coupling between a TM mode and a TEM mode.

FIG. 4 is a graph showing the relationship between a length E6 (FIG. 1) of the coupling adjusting block 17 and a coupling coefficient k12 between the two resonance modes. As the length E6 becomes longer, the coupling coefficient k12 of the two resonance modes increases.

Thus, a predetermined coupling coefficient can be obtained simply by setting the size of the coupling adjusting block 17. However, in order to adjust the coupling coefficient from the outside of the cavity after the resonator device is assembled, as shown in FIG. 1, a metal screw 7 is also provided, so that a coupling adjusting member is provided by the portion of the screw 7 projecting into the cavity (having length E5). In the example shown in FIG. 1, the metal screw 7 is arranged in a position opposing the coupling adjusting block 17 with the conductive rod 4 therebetween. As a result, as the length E5 of the metal screw 7 inserted into the cavity increases, the coupling effect due to the coupling adjusting block 17 is reduced. Accordingly, although the size of the coupling adjusting block 17 may be predetermined so that a high coupling coefficient can be obtained, the metal screw 7 can be inserted in such a manner that the coupling coefficient becomes lower.

Furthermore, in FIG. 1, the coupling adjusting block 17 is not strictly necessary. Coupling can be provided just by the metal screw 7 which is inserted into the cavity from the outside as shown. As the metal screw's insertion amount E5 increases, the coupling coefficient is also increased.

Figure 5:
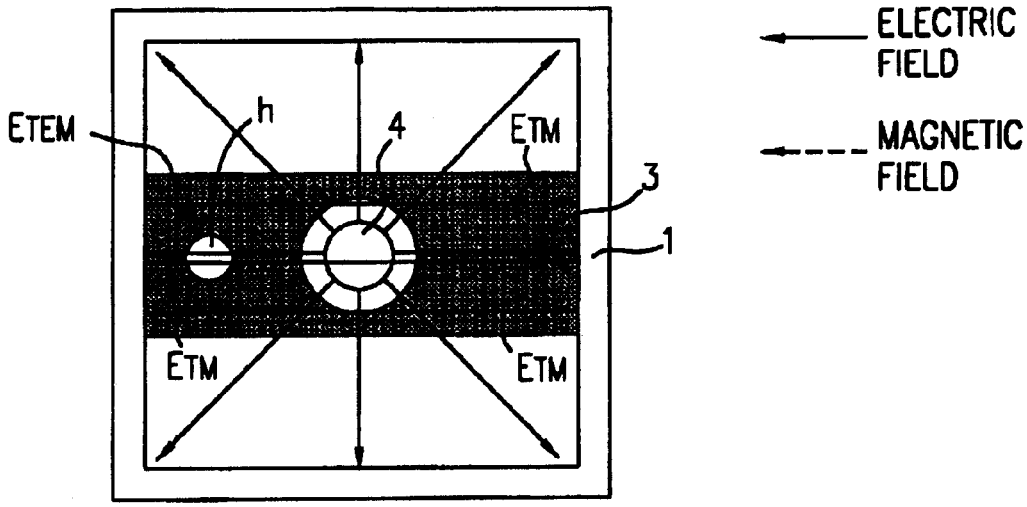
FIG. 5 illustrates the coupling of the two resonance modes in the dual-mode resonator.

FIG. 5 shows a structural example for coupling the two modes. Here, the figure is a top view before the cover is disposed. Electric-field vectors ETEM of the TEM mode are oriented in directions radial to the conductive rod 4 and electric-field vectors $E_{TM}$ of the TM mode orient in the lengthwise direction of the dielectric core 3. Thus, the two modes can be coupled with each other by disturbing the equilibrium of the electric-field strength from one end of the lengthwise direction of the dielectric core 3 to the center thereof (conductive rod 4) and the electric-field strength from the other end to the center thereof. The symbol h shown in the figure indicates a coupling adjusting hole, by which the symmetry of the electric-field strengths in the neighboring area is cancelled, with the result that the TEM mode and the TM mode couple with each other. Additionally, the amount of coupling is determined by the size (the inner diameter or the depth) of the coupling adjusting hole h or by the amount of a dielectric rod inserted in the coupling adjusting hole h.

Next, as a second embodiment of the present invention, a resonator device having three resonators will be described with reference to FIGS. 6A to 6D to FIGS. 9A and 9B.

Figure 6A:
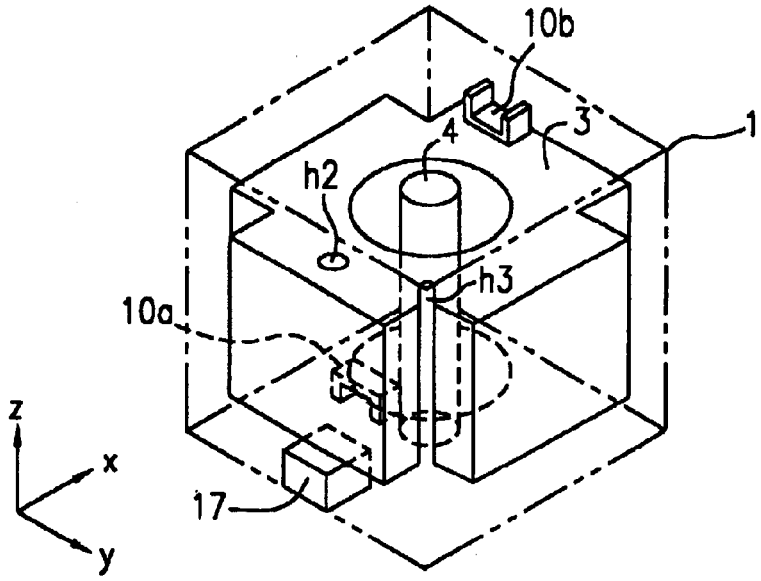
FIGS. 6A to 6D show a structure of a triplex-mode resonator device and triplex resonance modes in a resonator device according to a second embodiment of the present invention.
Figure 6B:
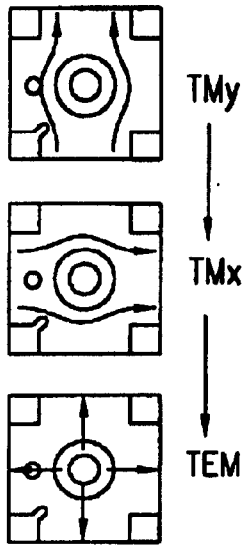
Figure 6C:
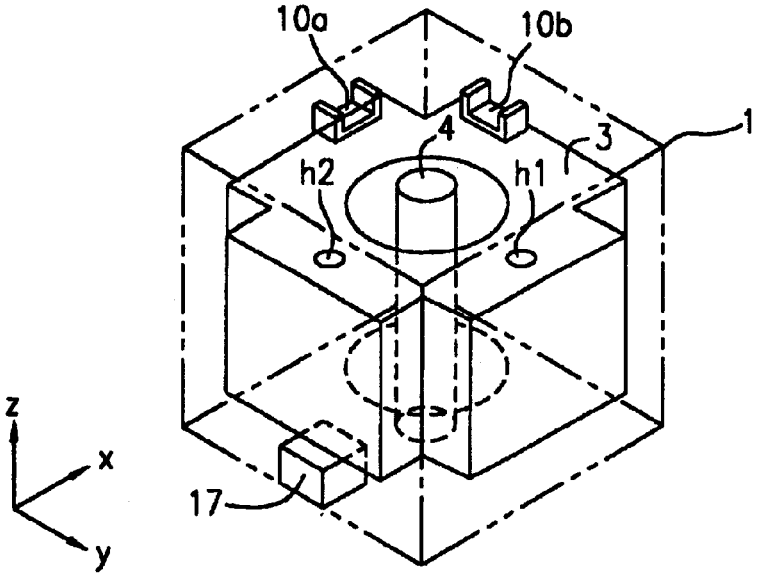

Each of FIGS. 6A and 6C is a perspective view of a resonator device using triplex resonance modes obtained by summing a TM dual mode and a TEM mode. In each of the figures, reference numeral 1 denotes a cavity and the inner surfaces of the cavity 1 are outlined by two-dot chain lines. A dielectric core 3 is formed by arranging two prism-shaped dielectric cores perpendicular to each other to make a configuration in the shape of a cross. At the center of the dielectric core 3, a cylindrical hole is formed and a conductive rod 4 is inserted therein.

In the example shown in FIG. 6A, as in the case of coupling between the single TM mode and the single TEM mode shown in FIGS. 3A to 3D, in this case, with a TMx mode and a TEM mode as two coupling modes, a coupling adjusting block 17 is disposed at a place where the magnetic field of one of the coupling modes is weak and the magnetic field of the other coupling mode is strong. With this arrangement, the TEM mode and the TM mode couple with each other by making a difference between the resonant frequencies of the two coupling modes.

In addition, a coupling adjusting hole h2 is disposed at one of the parts where the electric-field vectors of the TMx mode and the TEM mode significantly overlap each other, that is, in one of the arms of the cross-shaped core with the conductive rod 4 therebetween. The TMx mode and the TEM mode can be coupled by the hole h2.

Regarding the TMx mode and the TMy mode as the two coupling modes (even and odd modes), in order to make a difference between the resonant frequencies of the two modes, a coupling adjusting hollow h3 is provided. The hollow h3 provides the coupling between the TMx mode and the TMy mode.

A coupling loop 10*b* magnetically couples with the TMy mode and a coupling loop 10*a* magnetically couples with the TEM mode. As a result, the three resonance modes couple with one another in the sequential order of the coupling loop 10*a*, the TEM mode, the TMx mode, TMy mode, and the coupling loop 10*b*. With this arrangement, the device serves as a resonator device having three resonators.

Figure 6D:
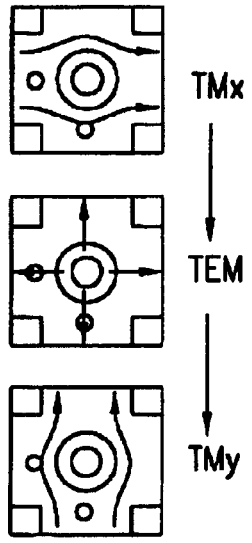

In the example shown in FIGS. 6C and 6D, like the example of FIGS. 6A and 6B, a coupling adjusting block 17 and a coupling adjusting hole h2 provide coupling between the TMx mode and the TEM mode. In addition, a coupling adjusting hole h1 is formed in one of the two parts in which electric-field vectors of the TMy mode and electric-field vectors of the TEM mode significantly overlap each other, that is, in one of the two arms of the cross-shaped dielectric core with the conductive rod 4 therebetween. The hole h1 provides coupling between the TMy mode and the TEM mode.

A coupling loop 10*a* magnetically couples with the TMx mode and a coupling loop 10*b* magnetically couples with the TMy mode. Consequently, the three resonators couple with one another in the sequential order of the coupling loop 10*a*, the TMy mode, the TEM mode, the TMx mode, and the coupling loop 10*b*. Thus, the device also serves as a resonator device having three resonators.

FIGS. 7A and 7B to FIGS. 9A and 9B show simulations of the magnetic-field distributions of the TEM mode and the TM mode and the magnetic-field distributions of the coupling modes of both modes. In this case, the coupling between the modes is made in the sequential order of the TMx mode, then the TEM mode, and then the TMy mode, as shown in FIG. 6D.

Figure 7A:
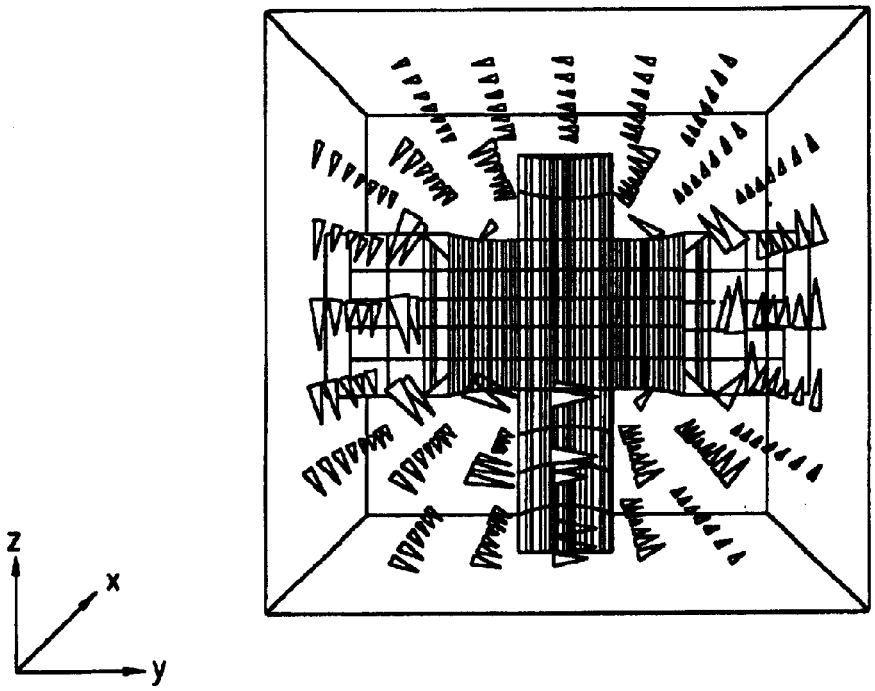
FIGS. 7A and 7B each show the magnetic-field distribution of a TM mode in the triplex-mode resonator.
Figure 7B:
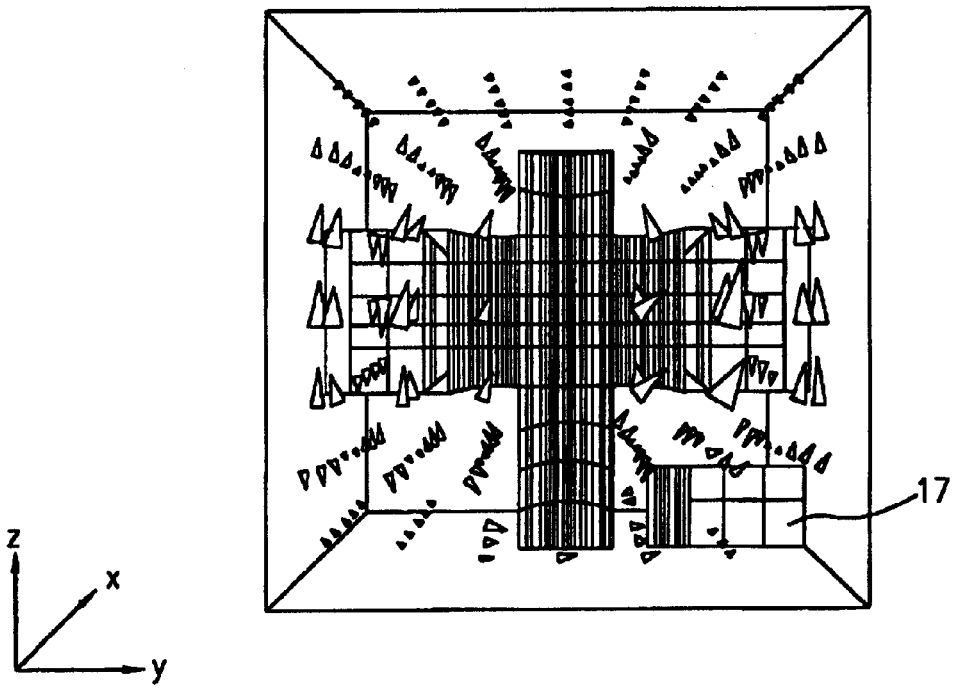

Alternatively, without forming a hole h1 as shown in FIG. 6C, the coupling between the TMy mode and the TEM mode may be obtained by narrowing one of the arms of the dielectric core to a width Wy2 (FIG. 8A) to disturb the equilibrium of electric-field strengths. FIGS. 7A and 7B each show the TMx mode coupling with the TEM mode, FIGS. 8A and 8B each show a first coupling mode formed by the TMy mode and the TEM mode, and FIGS. 9A and 9B each show a second coupling mode formed by the TMy mode and the TEM mode.

In FIG. 7A, an axis y indicates the right and left direction, an axis x indicates the front and back direction, and an axis z indicates the upper and lower direction. In FIG. 7B, the axis x indicates the right and left direction, the axis y indicates the front and back direction, and the axis z indicates the upper and lower direction. In each of FIGS. 8A and 9A, the axis y indicates the right and left direction, the axis z indicates the front and back direction, and the axis x indicates the upper and lower direction. In each of FIGS. 8B and 9B, the axis x indicates the right and left direction, the axis y indicates the front and back direction, and the axis z indicates the upper and lower direction.

Figure 8A:
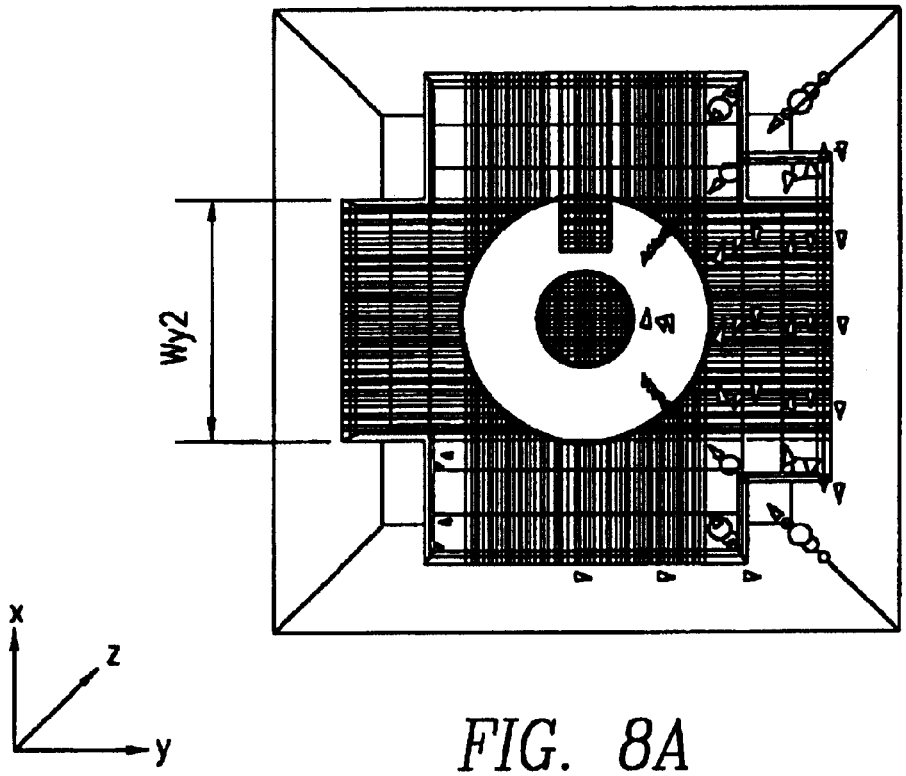
FIGS. 8A and 8B each show the magnetic-field distribution of a first coupling mode in the triplex-mode resonator.
Figure 8B:
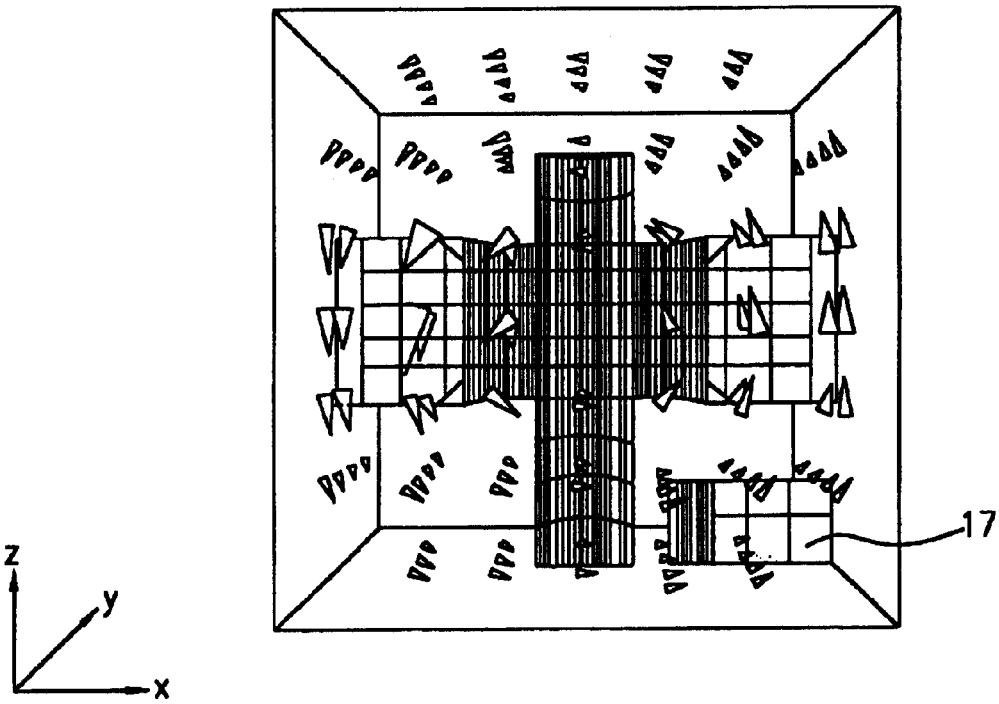
Figure 9A:
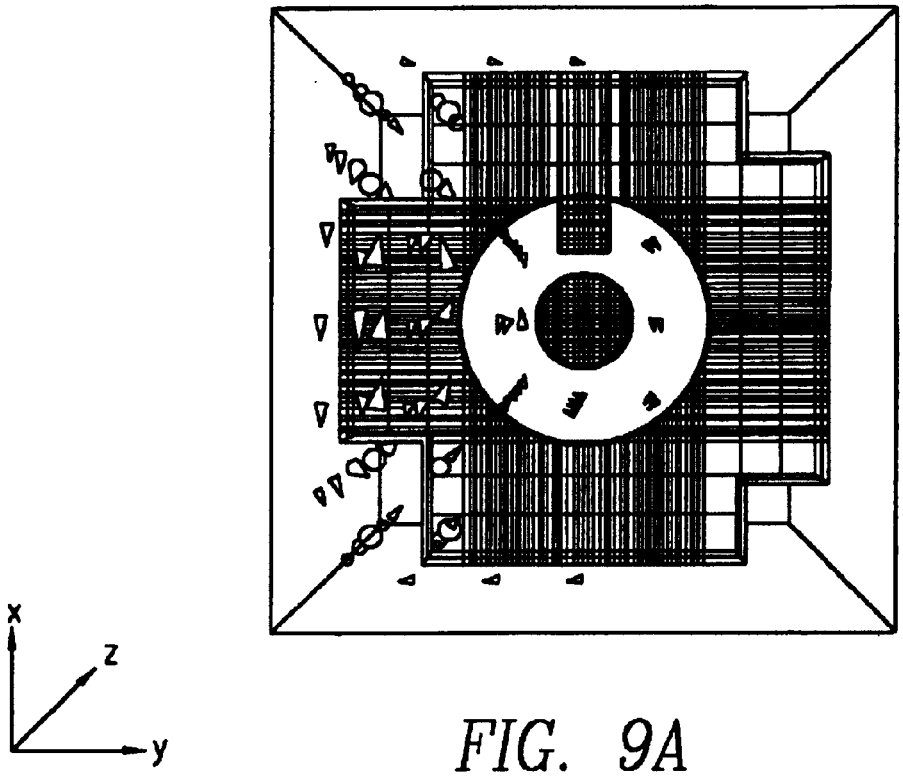
FIGS. 9A and 9B each show the magnetic-field distribution of a second coupling mode in the triplex-mode resonator.
Figure 9B:
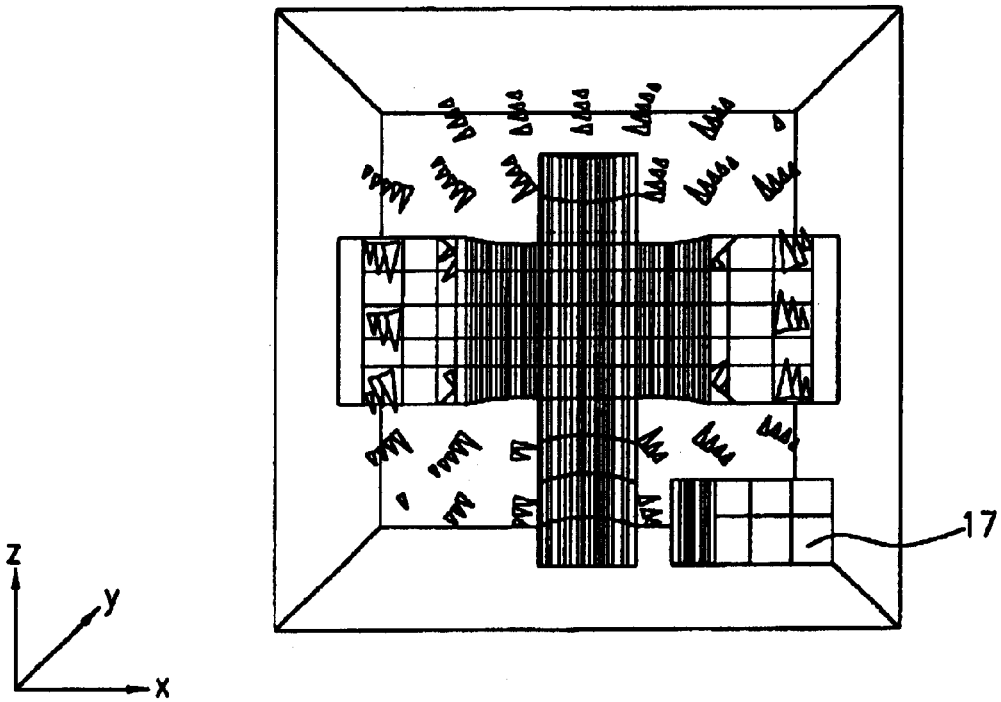

As seen by a comparison between FIGS. 7B, 8B, and 9B, at the position of the coupling adjusting block 17, the magnetic fields of the first and second coupling modes generated by the TMy mode and the TEM mode are weak and the coupling adjusting block 17 is positioned in parallel to the magnetic fields. On the other hand, the magnetic field of the TMx mode coupled with the TEM mode is intensified at the position of the coupling adjusting block 17 and the block is arranged perpendicularly to the magnetic field. Thus, the coupling adjusting block 17 has influence only upon the TMx mode coupled with the TEM mode shown in FIG. 7B and has little influence upon the other two modes. Accordingly, in a filter using such resonators, the adjustment of a given coupling mode can easily and independently be made.

Next, a filter according to a third embodiment of the present invention will be described with reference to FIG. 10.

Figure 10:
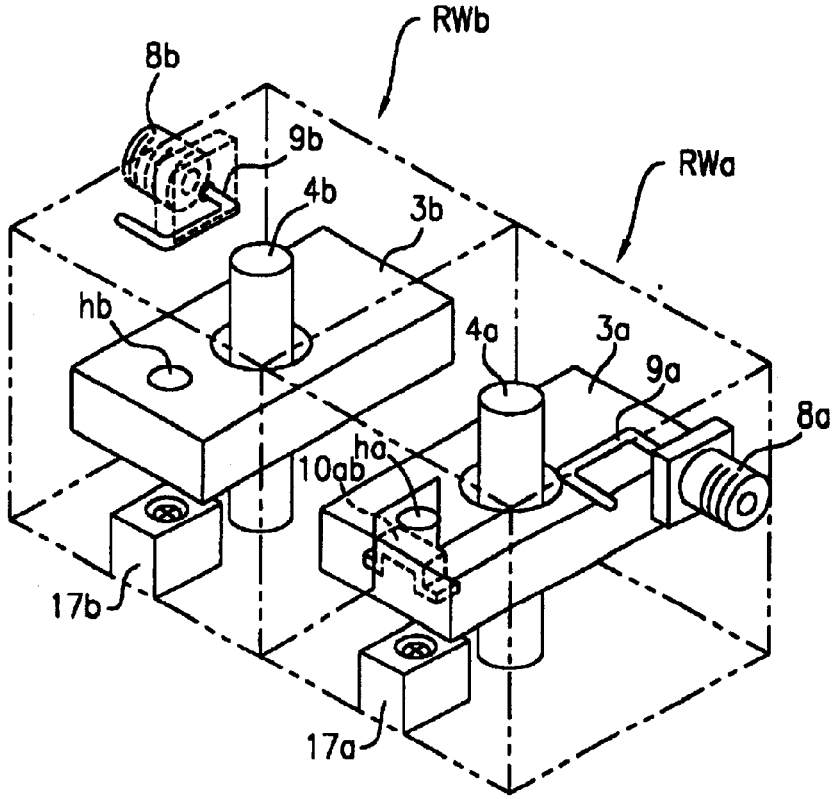
FIG. 10 shows the structure of a filter according to a third embodiment of the present invention.

In FIG. 10, each of reference characters RWa and RWb denotes a dual-mode resonator using a TM mode and a TEM mode. The basic structure of each resonator device is the same as that shown in FIG. 1 and FIGS. 2A to 2C. Reference numerals 8*a* and 8*b* denote coaxial connectors, and the central conductors of the coaxial connectors are connected to coupling loops 9*a* and 9*b*. A coupling loop 10*ab* is coupled with the TEM-mode magnetic fields of the dual-mode resonators RWa and RWb. As a result, the two TEM modes couple with each other via the coupling loop 10*ab*. The coupling adjusting blocks 17*a* and 17*b* provide coupling between the TM modes and the TEM modes of the dual-mode resonators RWa and RWb. Coupling adjusting holes ha and hb are provided for adjusting the couplings between the TM modes and the TEM modes of the dual-mode resonators RWa and RWb. By inserting a dielectric rod in each of the holes from the outside of the cavity, the coupling coefficient of both modes can be freely adjusted according to the amount of insertion.

In this manner, the filter serves as a band pass filter having four resonators.

Next, a duplexer according to a fourth embodiment of the invention will be described with reference to FIG. 11.

Figure 11:
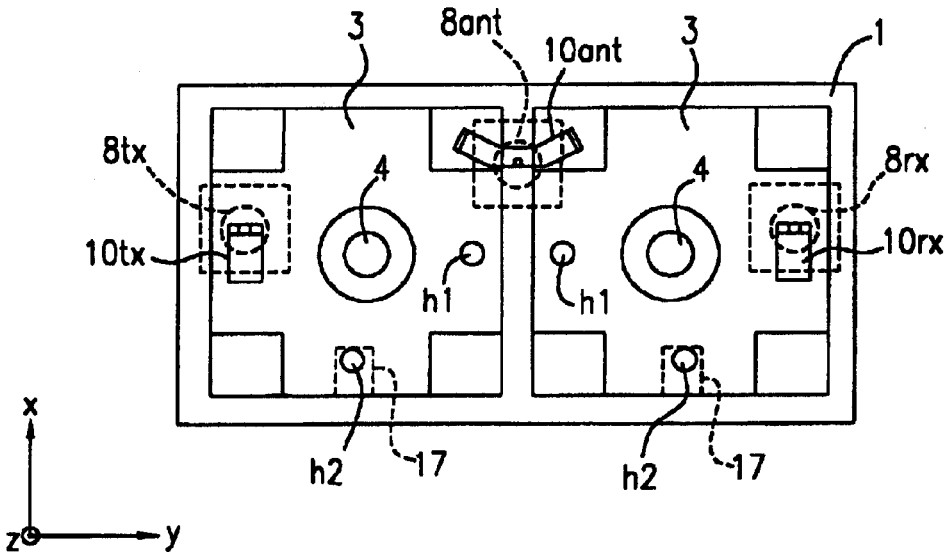
FIG. 11 shows the structure of a duplexer according to a fourth embodiment of the present invention.

In FIG. 11, the structure including a cavity 1 and a dielectric core 3 is the same as the structure of the resonator device shown in FIG. 6B, and this duplexer includes a pair of the resonator devices. In FIG. 11, reference numeral 10*tx* denotes a coupling loop which serves as a transmission signal input port, and which is connected between the central conductor of the coaxial connector 8*tx* and the cavity's cover (which is not shown in FIG. 11). Additionally, reference numeral 10*rx* denotes a coupling loop which serves as a reception signal output port, and which is connected between the central conductor of the coaxial connector 8*rx* and the cavity's cover. Reference numeral 10*ant* is a coupling loop which serves as an antenna connecting port, and both ends thereof are connected to the cavity's cover. The central conductor of the coaxial connector 8*ant* is connected to a predetermined position on the coupling loop 10*ant*.

With the above structure, the left-hand section shown in FIG. 11 serves as a transmission filter having band pass characteristics. In this filter, three resonators are coupled in the sequential order of the coupling loop 10*tx*, the TMx mode, the TEM mode, the TMy mode, and the coupling loop 10*ant*.

The right-hand section shown in FIG. 11 serves as a reception filter having band pass characteristics, in which the three resonators are coupled in the sequential order of the coupling loop 10*ant*, the TMy mode, the TEM mode, the TMx mode, and the coupling loop 10*rx*.

Next, the structure of a dual-mode resonator according to a fifth embodiment of the present invention will be described with reference to FIGS. 12A and 12B to FIG. 14.

Figure 12A:
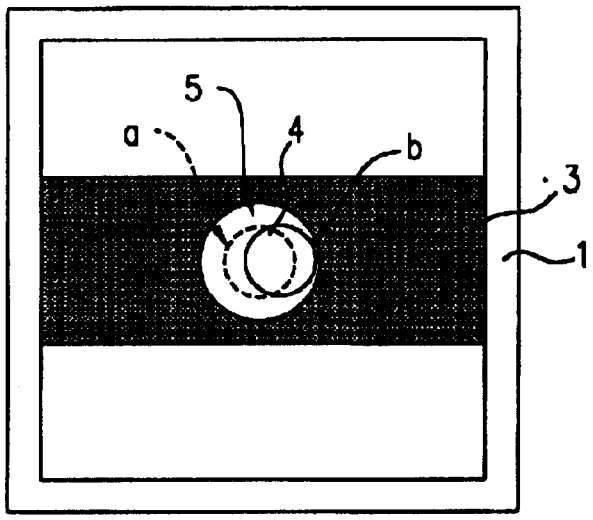
FIGS. 12A and 12B each show a resonator device according to a fifth embodiment of the present invention.
Figure 12B:
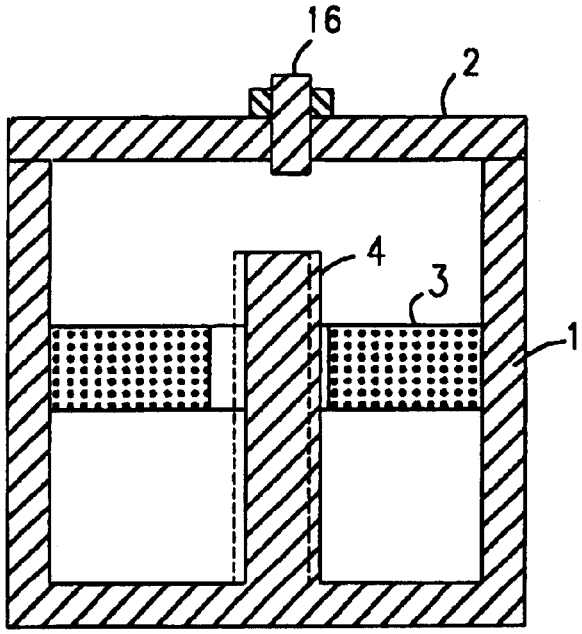

FIG. 12A is a top view after a cavity's cover is removed and FIG. 12B is a longitudinal section cut by a surface along the central axis of a conductive rod. Unlike the resonator device shown in FIG. 1, in this embodiment, the TEM mode and the TM mode are coupled with each other without forming a coupling adjusting hole h in a dielectric core 3, and also, without disposing a coupling adjusting block 17 in the cavity.

In other words, in this embodiment, a hole 5 for inserting the conductive rod 4 is formed at the center of the dielectric core 3 (the center of the cavity 1) and the conductive rod 4 is arranged with its center shifted from the center of the hole 5. The other structures are the same as those shown in FIG.

1. A broken line indicates a state in which the conductive rod 4 and the hole 5 are concentrically positioned. In this embodiment, the conductive rod is not positioned at the center of the hole as indicated by the symbol a, but rather is shifted to a location indicated by the symbol b.

Figure 13A:
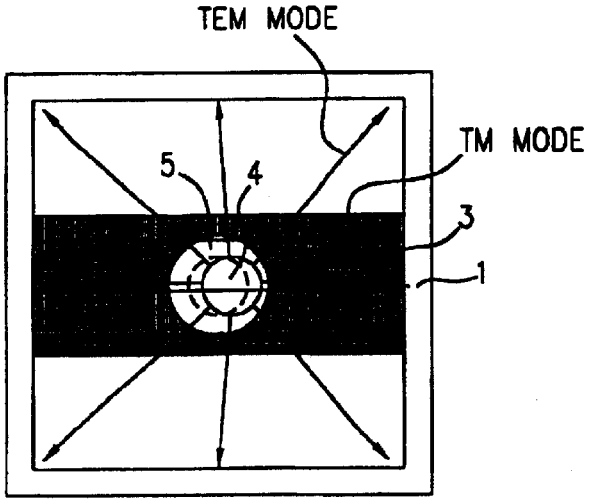
FIGS. 13A to 13C illustrate examples of electric-field distributions of resonance modes in the resonator device of the fifth embodiment.
Figure 13B:
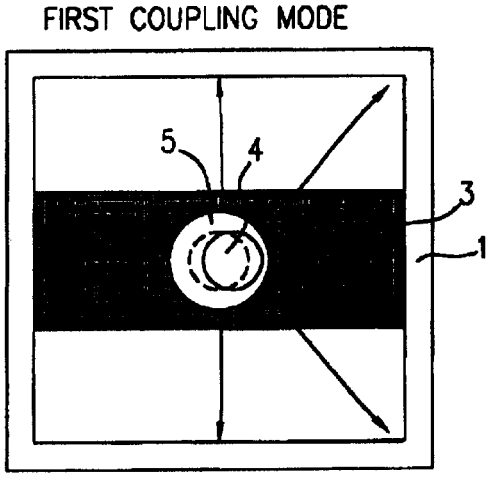
Figure 13C:
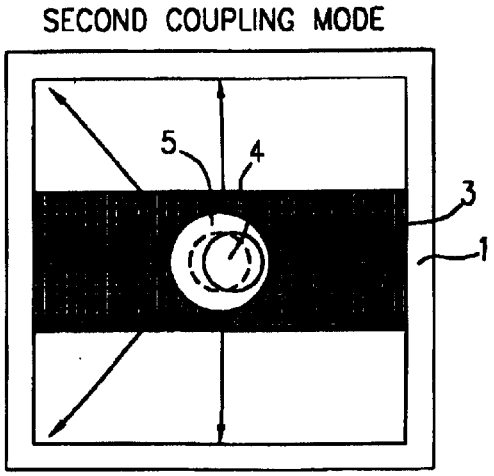

FIGS. 13A to 13C indicate the examples of electric-field distributions of the modes. FIG. 13A shows the electric-field distribution of a TEM mode generated by the conductive rod 4 and the cavity 1 and the electric-field distribution of a TM mode generated by the dielectric core 3 and the cavity 1. FIG. 13B shows the electric-field distribution of a first coupling mode obtained by summing the TEM mode and the TM mode. FIG. 13C shows the electric-field distribution of a second coupling mode as the mode of a difference between the TEM mode and the TM mode.

As shown above, since the center of the conductive rod 4 is shifted from the center of the hole 5 in which the rod 4 is inserted, a difference is generated between the perturbation quantities of the hole 5 formed in the dielectric core with respect to the electric-field distributions of the two coupling modes. As a result, the frequencies of the two coupling modes become different and thereby the TM mode couples with the TEM mode. In the examples shown in FIGS. 13A to 13C, when compared with the case in which the conductive rod 4 is at the center of the hole 5, the frequency of the first coupling mode becomes lower, whereas the frequency of the second coupling mode becomes higher.

Figure 14:
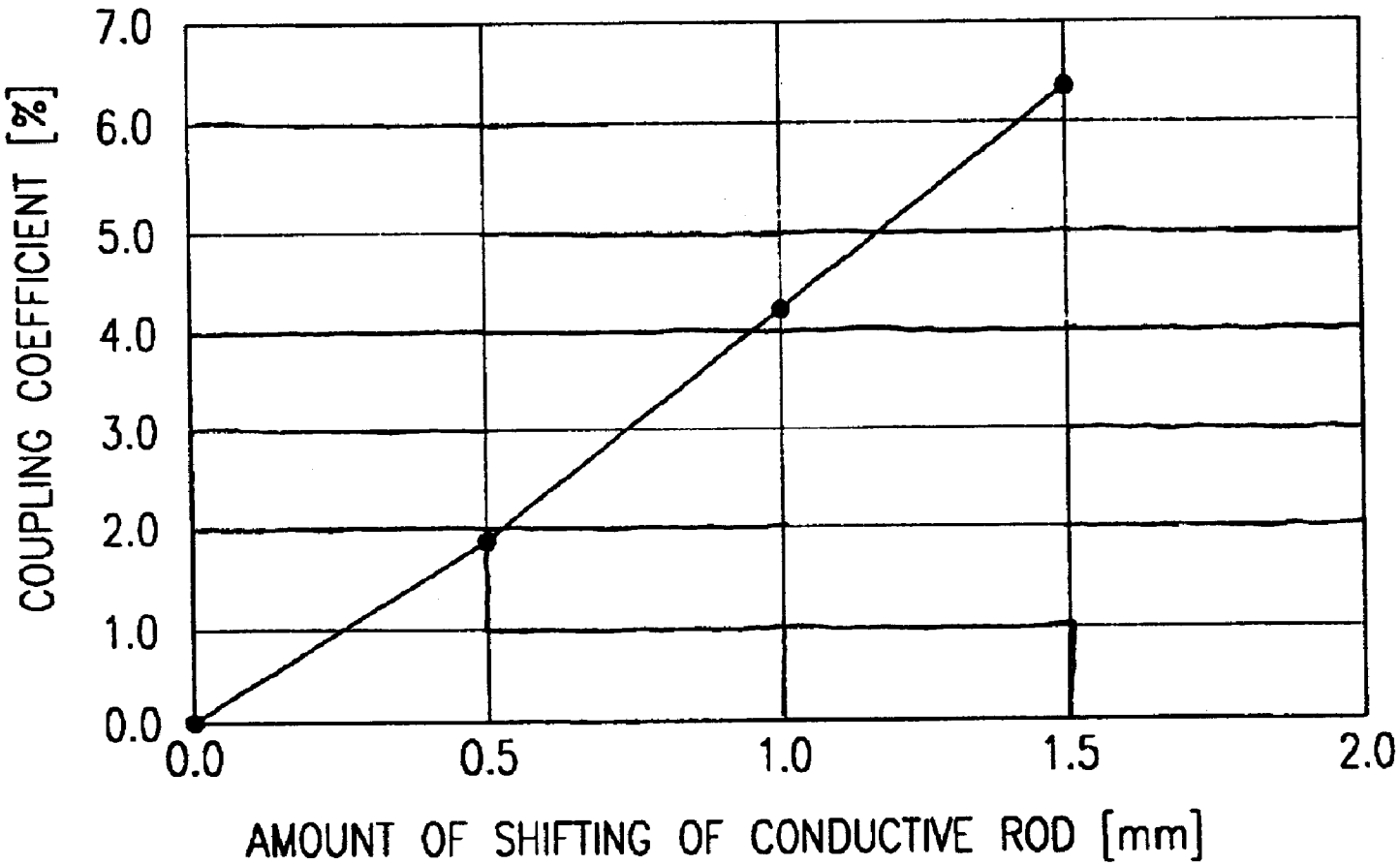
FIG. 14 is a graph showing the relationship between the amount of shifting of a conductive rod and the coupling coefficient between a TM mode and a TEM mode in the resonator device of the fifth embodiment.

FIG. 14 shows the relationship between the amount of shifting of the center of the conductive rod 4 from the center of the hole 5 formed in the dielectric core and the coupling coefficient between the modes. When the center of the hole 5 is positioned in the same place as the center of the conductive rod 4, that is, when the amount of shifting is equal to zero, the coupling coefficient between the TM mode and the TEM mode is zero. As the amount of shifting of the conductive rod increases, the coupling coefficient accordingly becomes higher. Consequently, the coupling coefficient between the TM mode and TEM mode can be determined depending on the position of the conductive rod with respect to the dielectric core or in the cavity.

Next, with reference to FIGS. 15A and 15B to FIG. 17, a description will be given of the structure of a dual-mode resonator device according to a sixth embodiment of the present invention.

Figure 15A:
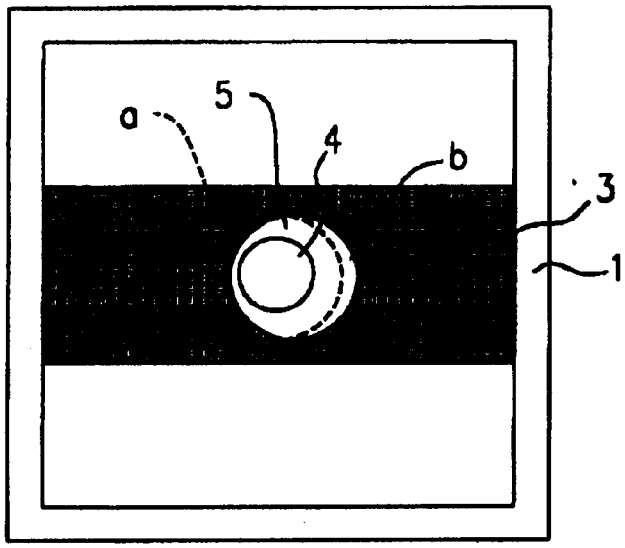
FIGS. 15A and 15B each show the structure of a resonator device according to a sixth embodiment of the present invention.
Figure 15B:
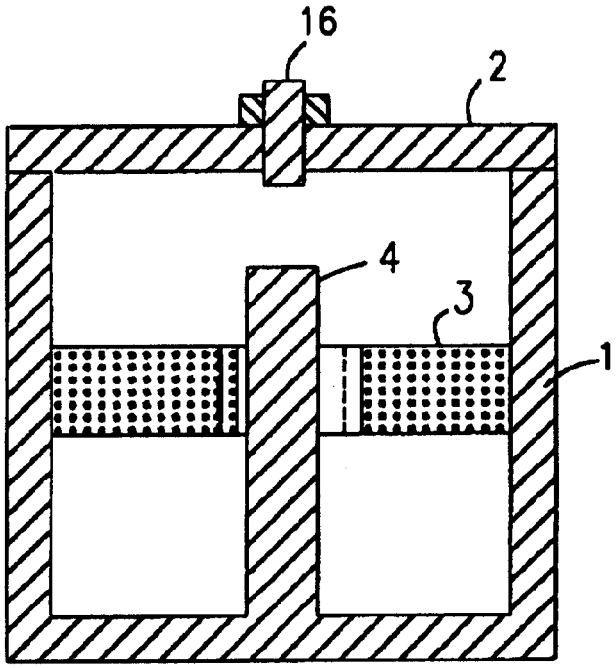

FIG. 15A is a top view of the device after a cavity's cover is removed and FIG. 15B is a longitudinal section cut by a surface along the central axis of a conductive rod. Similarly, in this embodiment, unlike the resonator device shown in FIG. 1, the TEM mode is coupled with the TM mode without forming a coupling adjusting hole h in a dielectric core 3 and without disposing a coupling adjusting block 17 in the cavity.

In other words, in this embodiment, a conductive rod 4 is disposed at the center of a cavity 1 and a hole 5 is formed in such a manner that the center of the hole 5 is shifted from the center of the conductive rod 4. The other structures are the same as those shown in FIG. 1. A broken line shows a state in which the hole 5 is concentric with the conductive rod 4. In this embodiment, the central hole 5 is not located concentrically with the conductive rod as indicated by the symbol a, but rather is shifted to a location indicated by the symbol b.

Figure 16A:
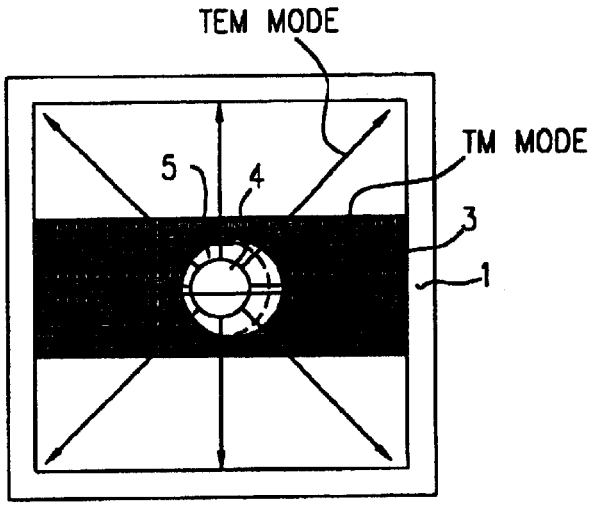
FIGS. 16A to 16C illustrate examples of electric-field distributions of resonance modes in the resonator device of the sixth embodiment.
Figure 16B:
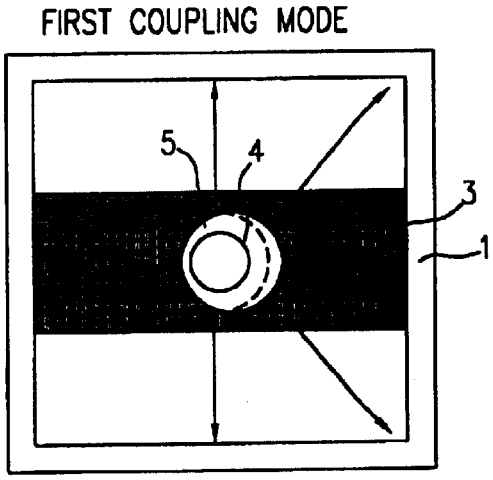
Figure 16C:
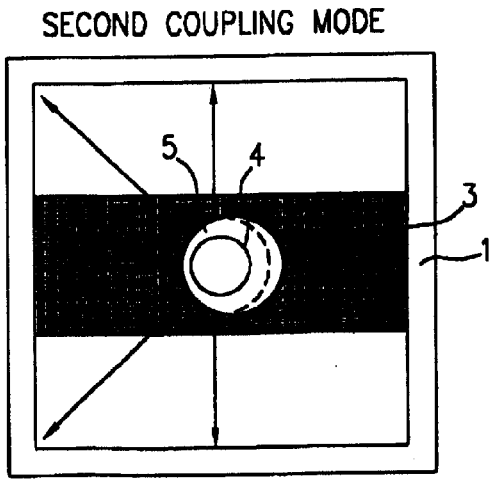

FIGS. 16A to 16C show the examples of electric-field distributions of the modes. FIG. 16A shows the electric-field distributions of the TEM mode and the TM mode. FIG. 16B shows the electric-field distribution of a first coupling mode as the mode of a sum of the TEM mode and the TM mode. FIG. 16C shows the electric-field distribution of a second coupling mode as the mode of a difference between the TEM mode and the TM mode.

Since the center of the conductive rod 4 relatively shifts from the center of the hole 5 through which the conductive rod 4 passes, a difference is generated between the perturbation quantities of the hole 5 formed in the dielectric core with respect to the electric-field distributions of the two coupling modes. As a consequence, the frequencies of the coupling modes become different, with the result that the TM mode couples with the TEM mode. In the embodiment shown in FIGS. 16A to 16C, when compared with the case in which the hole 5 and the conductive rod 4 are concentrically positioned, the frequency of the first coupling mode becomes higher, whereas the frequency of the second coupling mode becomes lower.

Figure 17:
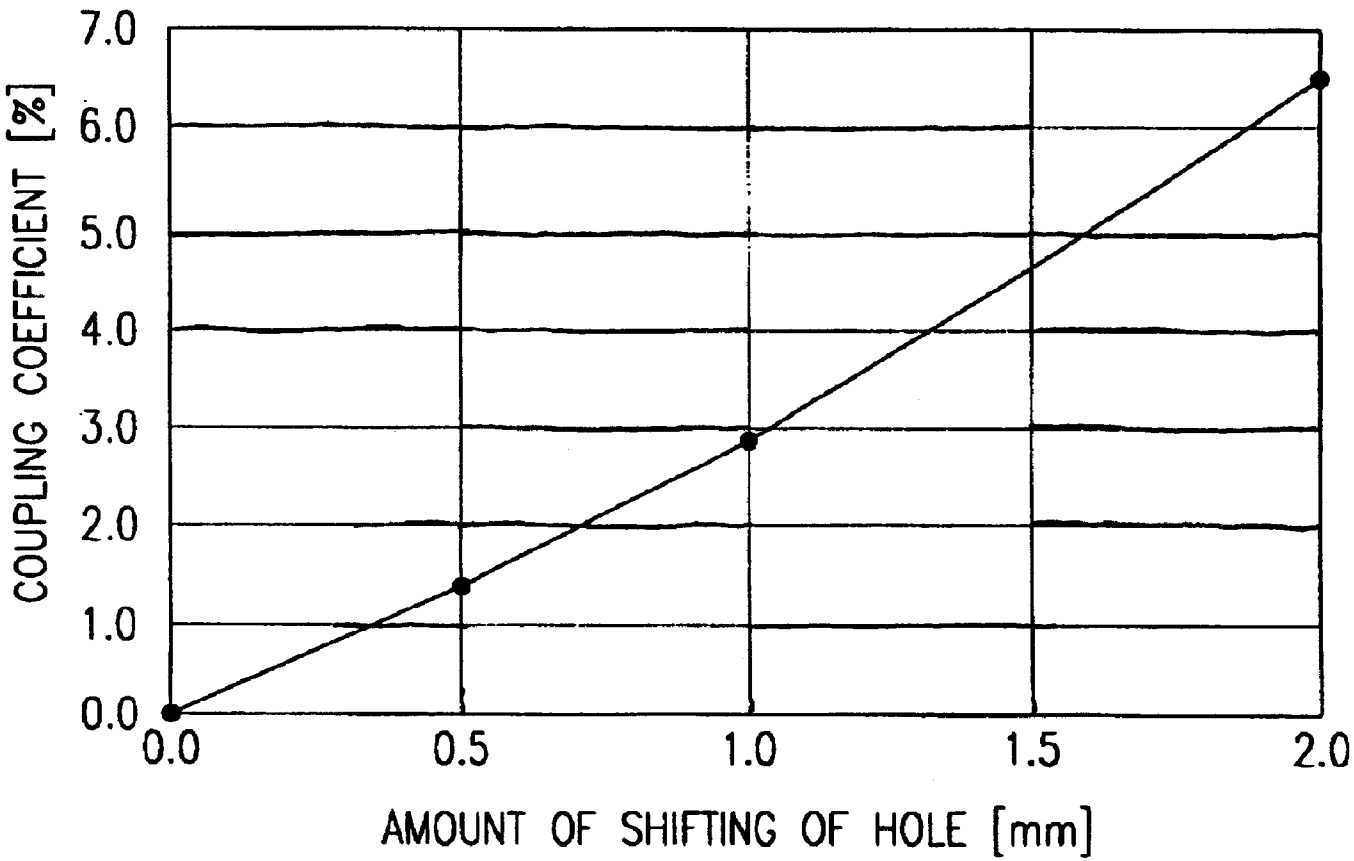
FIG. 17 is a graph showing the relationship between the amount of shifting of a hole and the coefficient of coupling in the resonator device of the sixth embodiment.

FIG. 17 shows the relationship between the coupling coefficient and the amount of shifting of the center of the hole 5 from the conductive rod 4. When the center of the hole 5 formed in the dielectric core is at the same position as the center of the conductive rod 4, that is, when the amount of shifting is zero, the coupling coefficient between the TM mode and the TEM mode is zero. As the amount of shifting of the hole 5 increases, the coupling coefficient becomes higher according to that. Thus, the coupling coefficient between the TM mode and the TEM mode can be determined by the position of the hole 5 with respect to the conductive rod 4.

Figure 18A:
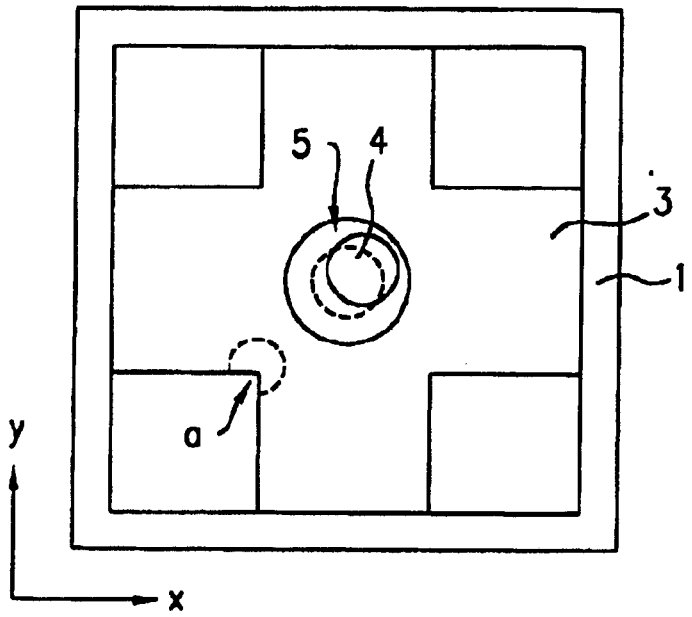
FIGS. 18A and 18B each show the structure of a resonator device according to a seventh embodiment of the present invention.
Figure 18B:
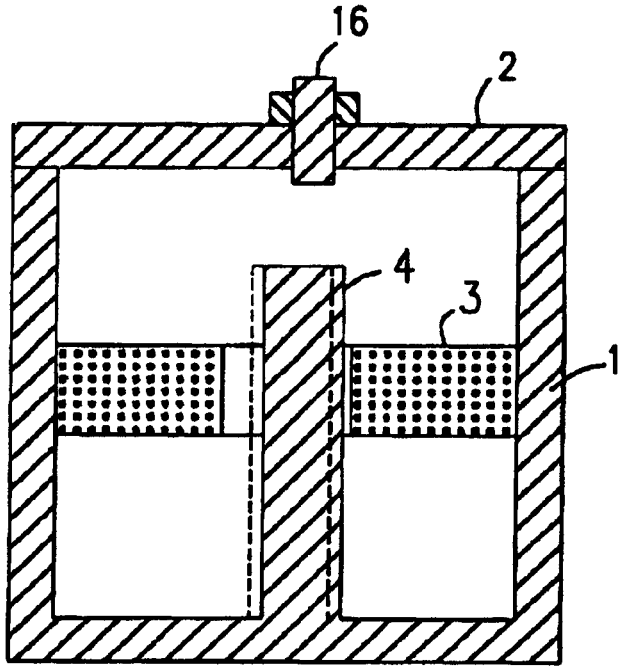

Next, as a seventh embodiment of the present invention, a resonator device will be described with reference to FIGS. 18A, 18B, and 19.

The resonator device includes a cross-shaped dielectric core 3 having a part extending in the axis x direction and a part extending in the axis y direction. At the center of the dielectric core 3, there is formed a hole 5 through which a conductive rod 4 passes. With this structure, the three modes of a TMx mode, a TMy mode, and a TEM mode can be used.

Figure 19:
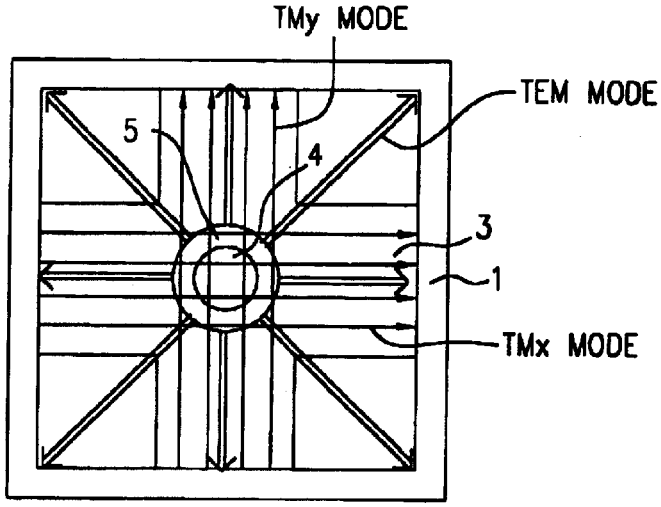
FIG. 19 illustrates an example of electric-field distributions of three resonance modes in the resonator device of the seventh embodiment.

FIG. 19 shows the examples of electric-field distributions of the above three modes. When the hole 5 is formed at the center of the dielectric core 3 and the conductive rod 4 and the hole 5 are concentrically positioned, the electric-field distributions of the three modes are symmetrical and therefore the modes do not couple with each other. However, as shown in FIGS. 18A and 18B, when the conductive rod 4 is arranged in a manner shifted from the center in the axis x direction by a predetermined amount, like the dual-mode resonator device described above, the TMx mode couples with the TEM mode. In addition, shifting of the conductive rod 4 in the axis y direction enables the coupling between the TMy mode and the TEM mode.

Furthermore, when the center of the conductive rod 4 shifts from the center of the hole 5 in both of the axis x direction and the axis y direction, a perturbation quantity is added to each of the electric-field distributions of the two coupling modes obtained by the TMx mode and the TMy mode. Consequently, the TMx mode and the TMy mode couple with each other. If the coupling between the TMx mode and the TMy mode is unnecessary, the dielectric part indicated by the symbol a can be cut away by a predetermined amount in order to cancel the coupling.

Figure 20:
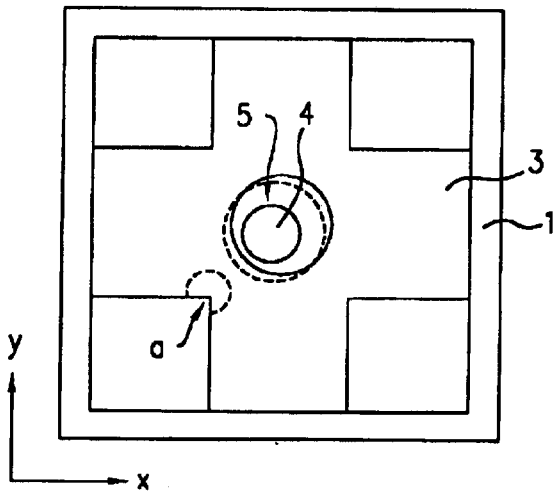
FIG. 20 shows the structure of a resonator device according to an eighth embodiment of the present invention.

Next, with reference to FIG. 20, a description will be given of the structure of a resonator device according to an eighth embodiment of the present invention.

In the embodiment shown in FIG. 18, the hole 5 is formed in the center of the cross-shaped dielectric core 3. However, in this embodiment, a conductive rod 4 is arranged in the center of the dielectric core 3 (the center of a cavity 1) and a hole 5 is formed in a location with the center of the hole 5 shifted from the center of the conductive rod 4. In this case, similar to the above embodiment, the amount of coupling between the TMx mode and the TEM mode is determined by the shifting of the hole 5 in the axis x direction and the amount of coupling between the TMy mode and the TEM mode is determined by the shifting of the hole 5 in the axis y direction. Similarly, due to the shifting of the hole 5 with respect to the dielectric core 3 in both axes x and y directions, the coupling between the TMx mode and the TMy mode occurs. However, the coupling between the TMx mode and the TMy mode can be prevented, for example, by cutting a certain amount of the dielectric part indicated by the symbol a so that electric-field distributions of the two coupling modes obtained by the TMx and TMy modes can be balanced.

In each of the embodiments shown in FIGS. 12A and 12B to FIG. 20, the TEM mode is coupled with the TM mode by setting the position of the hole formed in the dielectric core with respect to the conductive rod. In addition, the structures providing the coupling between specified modes as shown in each of the embodiments of FIGS. 1–11 may be combined with them.

Figure 21:
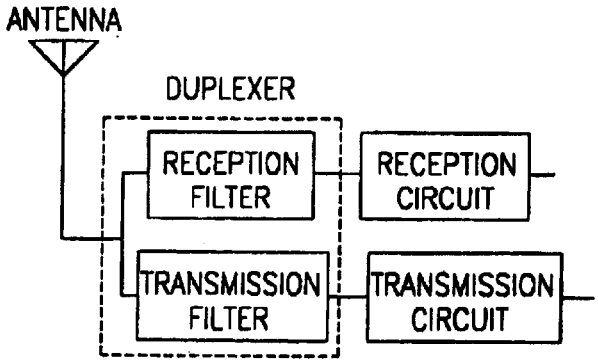
FIG. 21 shows a block diagram of a communication apparatus according to a ninth embodiment of the present invention.

FIG. 21 shows a block diagram of a communication apparatus according to a ninth embodiment of the present invention. The communication apparatus uses the duplexer described above. As shown here, a transmission circuit is connected to an input port of a transmission filter and a reception circuit is connected to an output port of a reception filter. An antenna is connected to an input and output port of the duplexer. With this structure, a high frequency section of the communication apparatus is formed.

In addition, circuit elements such as a multiplexer, a synthesizer, and a divider can be formed by the dielectric resonator device described in each of the above embodiments. Also, when these circuit elements are used for forming a communication apparatus, the communication apparatus can be made compact.

As described above, according to the present invention, in a conductive cavity, there are arranged a dielectric core and a conductive rod that has at least one end conducted to the inside of the conductive cavity. The resonant frequency of a quasi-TEM mode generated by the cavity and the conductive rod and the resonant frequency of a quasi-TM mode generated by the cavity and the dielectric core are substantially equalized, and also a conductive member is disposed such that it is disposed at or removed from a place where the magnetic field of one of two coupling modes generated by the quasi-TEM mode and the quasi-TM mode is strong and the magnetic field of the other coupling mode is weak.

Alternatively, a dielectric member and a conductive member are disposed such that they are disposed at or removed from a place where the electric field of one of two coupling modes generated by the quasi-TEM mode and the quasi-TM mode is strong and the electric field of the other coupling mode is weak.

As a result, without making the entire structure complicated, the quasi-TEM mode and the quasi-TM mode can be coupled with each other with a predetermined coupling strength.

In addition, in this invention, in a conductive cavity, there are arranged a dielectric core and a conductive rod having at least one end conducted to the inside of the cavity. The resonant frequency of a quasi-TEM mode generated by the cavity and the conductive rod and the resonant frequency of a quasi-TM mode generated by the cavity and the dielectric core are substantially equalized, and a dielectric member and a conductive member are disposed such that they are disposed at or removed from a place where the electric-field vectors of the quasi-TEM mode and the quasi-TM mode significantly overlap each other.

Alternatively a dielectric member and a magnetic member are disposed such that they are disposed at or removed from a place where the magnetic-field vectors of the quasi-TEM mode and the quasi-TM mode significantly overlap each other.

With each of the above structures, consequently, without making the entire structure complicated, the quasi-TEM mode and the quasi-TM mode can be coupled with each other with a predetermined coupling strength.

Furthermore, in this invention, a hole is formed substantially at the center of the dielectric core and the conductive rod is passed through the hole. The conductive rod is arranged in such a manner that the center of the conductive rod is shifted from the center of the hole.

Alternatively, a hole, through which the conductive rod passes, is formed in the dielectric core in such a manner that the center of the hole is shifted from the center of the conductive rod.

As a consequence, neither the disposition of any coupling member nor the removal of any member is substantially needed. Thus, only with the arrangement of the conductive rod or the formation of the hole for inserting the conductive rod, the quasi-TEM mode and the quasi-TM mode can be coupled with each other easily.

In addition, in this invention, regarding the quasi-TM mode, when there is provided a quasi-TM mode resonator of dual modes whose electric fields are perpendicular to the dielectric core, the resonator device can have a triplex-mode resonator including the dual quasi-TM modes and the quasi-TEM mode. Thus, the entire structure of the resonator device can be made compact.

In this invention, when the conductive member is disposed on an inner surface of the cavity at a position overlapping with the dielectric core when viewed from the axial direction of the conductive rod, bonding and arrangement of the coupling conductive member can be simplified, which facilitates production of the device.

Additionally, in this invention, when the conductive member is integrally molded with the cavity, the production of the device can be facilitated.

In addition, in this invention, when the conductive member is a metal screw and the amount of insertion into the cavity can be changed from the outside, coupling can be adjusted easily with the conductive member by a turning operation.

In this invention, a filter having the above advantages can be easily formed.

In this invention, a duplexer having the above advantages can be easily formed.

In this invention, a communication apparatus having the above advantages can be easily formed.

While embodiments of the invention have been described above, it is to be understood that various changes and modifications may be made without departing from the scope and spirit of the invention as hereinafter claimed.

What is claimed is:

1. A resonator device comprising:

a conductive cavity;

a conductive rod disposed in the cavity, at least one end of the conductive rod being conductively connected to the inside of the cavity;

a dielectric core disposed in the cavity, the resonant frequency of a quasi-TEM mode generated by the conductive rod and the cavity being substantially equalized with the resonant frequency of a quasi-TM mode generated by the dielectric core and the cavity; and a conductive member disposed at a position where the magnetic field of one of two coupling modes generated by the quasi-TEM mode and the quasi-TM mode is strong and the magnetic field of the other coupling mode is weak.

2. The resonator device according to claim 1, wherein the quasi-TM mode includes dual quasi-TM modes whose electric fluids are directed perpendicularly to the dielectric core.

3. The resonator device according to claim 1, wherein the conductive member is a conductive protrusion disposed on an inner surface of the cavity at a position overlapping with the dielectric core when viewed from an axial direction of the conductive rod.

4. The resonator device according to claim 1, wherein the conductive member is integrally molded with the cavity.

5. The resonator device according to claim 1, wherein the conductive member is a metal screw having an amount of insertion into the cavity which can be adjusted from the outside.

6. A filter comprising the resonator device according to claim 1, the resonator device including input and output conductors for inputting and outputting signals by coupling with a predetermined resonance mode of the quasi-TEM and the quasi-TM resonance modes.

7. A duplexer comprising a pair of filters formed by the filter according to claim 6, wherein the input port of a first filter is a transmission signal input port, the output port of a second filter is a reception signal output port, and an input and output port common to the first and seconds filters is an antenna port.

8. A communication apparatus comprising the filter according to claim 6.

9. A communication apparatus comprising the duplexer according to claim 7.

10. A resonator device comprising:

a conductive cavity;

a conductive rod disposed in the cavity, at least one end of the conductive rod being conductively connected to the inside of the cavity; and a dielectric core disposed in the cavity, the resonant frequency of a quasi-TEM mode generated by the cavity and the conductive rod being substantially equalized with the resonant frequency of a quasi-TM mode generated by the cavity and the dielectric core, wherein the dielectric core includes a hole provided at a position where the electric field of one of two coupling modes generated by the quasi-TEM mode and the quasi-TM mode is strong and the electric field of the other coupling mode is weak, the hole being formed substantially at the center of the dielectric core and surrounding the conductive rod, and the conductive rod is arranged in such a position that the center of the conductive rod is shifted from the center of the hole.

11. A resonator device comprising:

a conductive cavity;

a conductive rod disposed substantially at the center of the cavity, at least one end of the conductive rod being conductively connected to the inside of the cavity; and a dielectric core disposed in the cavity, the resonant frequency of a quasi-TEM mode generated by the cavity and the conductive rod being substantially equalized with the resonant frequency of a quasi-TM mode generated by the cavity and the dielectric core, wherein the dielectric core includes a hole provided at a position where the electric field of one of two coupling modes generated by the quasi-TEM mode and the quasi-TM mode is strong and the electric field of the other coupling mode is weak, the a hole being formed in the dielectric core and surrounding the conductive rod, and the hole being located in such a position that the center of the hole is shifted from the center of the conductive rod.

* * * * *